US005863621A

United States Patent [19]

Dearnaley et al.

[11] Patent Number: 5,863,621

[45] Date of Patent: Jan. 26, 1999

[54] NON-CHROMATE SEALANT FOR POROUS ANODIZED ALUMINUM

[75] Inventors: Geoffrey Dearnaley; Stephen J. Lukezich, both of San Antonio, Tex.

[73] Assignee: Southwest Research Institute, San Antonio, Tex.

[21] Appl. No.: 662,728

[22] Filed: Jun. 10, 1996

Related U.S. Application Data

[63] Continuation-in-part of Ser. No. 400,612, Mar. 8, 1995, abandoned.

[51] Int. Cl.[6] ..... C23C 14/00

[52] U.S. Cl. ..... 427/523; 427/385.5; 427/409; 427/525; 427/528; 427/529

[58] Field of Search ..... 427/523, 525, 427/529, 528, 385.5, 409

[56] References Cited

U.S. PATENT DOCUMENTS

| | | | |
|---|---|---|---|
| 3,715,211 | 2/1973 | Quaintance | 96/35.1 |
| 3,734,784 | 5/1973 | Bereday et al. | 148/6.27 |
| 4,022,925 | 5/1977 | Reuter et al. | 427/35 |
| 4,225,398 | 9/1980 | Hasegawa et al. | 204/33 |
| 4,483,751 | 11/1984 | Murayama et al. | 204/37.1 |
| 4,537,793 | 8/1985 | Kehrer et al. | 427/35 |
| 4,660,297 | 4/1987 | Danielson | 34/4 |
| 5,102,689 | 4/1992 | Bachmann et al. | 427/45.1 |
| 5,230,929 | 7/1993 | Caporiccio et al. | 427/536 |
| 5,279,866 | 1/1994 | Bourget et al. | 427/575 |
| 5,391,407 | 2/1995 | Dearnaley | 427/527 |
| 5,501,745 | 3/1996 | Dearnaley | 136/258 |

FOREIGN PATENT DOCUMENTS 49-5822 2/1974 Japan .

OTHER PUBLICATIONS

C. Bedell, et al., "Diamond–like carbon from the ion–beam decomposition of polyphenyl ether" *Applications of Diamond Films & Related Materials,* 833–838 (1991) Elsevier (No month avail.).

G. Dearnaley "Materials Science Aspects of Ion Beam Technology" *Surface Engineering* (1991) vol. 7 No. 2 (No month avail.).

K. Legg, "Surface Engineering with Ion–Assisted Coatings" *Nuclear Instruments and Methods in Physics Research* (1987) 565–567 (No month avail.).

"Diamond coating may be future of tool manufacture" *San Antonio Express News,* Apr. 1, 1996.

*Primary Examiner*—Bernard Pianalto
*Attorney, Agent, or Firm*—Madan & Morris, PLLC

[57] ABSTRACT

The present invention provides a method for easily and effectively removing adsorbed water molecules from an anodized surface using low intensity ultraviolet (UV) radiation. The present invention also provides a method for sealing an anodized aluminum surface which does not result in hazardous byproducts. The method involves, in vacuum: (1) vaporizing a selected precursor fluid; (2) condensing a flux of said precursor vapor onto the anodized aluminum surface; (3) and, bombarding said condensed precursor vapor with an energetic beam of ions to convert the porous anodized surface into an inert, solid, impermeable, and mechanically strong surface.

27 Claims, No Drawings

NON-CHROMATE SEALANT FOR POROUS ANODIZED ALUMINUM

CROSS-REFERENCE TO RELATED APPLICATION

This application is a continuation-in-part of application Ser. No. 08/400,612, filed on Mar. 8, 1995, abandoned.

FIELD OF THE INVENTION

The present invention relates to an improved method for sealing the porous surface of anodized aluminum and its alloys. The filling medium, which is chemically inert and impermeable, forms a mechanically strong amorphous or diamond like carbon coating that will withstand exposure to high temperatures. The process results in byproducts that are less hazardous to the environment than those produced by chromate solutions.

BACKGROUND OF THE INVENTION

Aluminum is commonly used to manufacture many different articles. When compared to steel, aluminum owes its versatility as an engineering material to its easy workability, its somewhat low specific gravity, and its relative resistance to corrosion by the ambient environment.

The resistance to corrosion exhibited by aluminum is due to the formation of a substantially transparent "natural" oxide layer upon exposure to air. Unfortunately, this "natural oxide" layer does not always have a uniform thickness. Because of this, natural oxides generally are removed from aluminum products, and the product thereafter is "anodized," or controllably oxidized, to provide a protective oxide layer with better quality.

Anodizing processes generally involve the use of a bath containing an electrolyte, such as sulfuric acid, oxalic acid, chromic acid, phosphoric acid, or combinations thereof, with or without certain addition agents. The aluminum workpiece generally is used as an anode and a component made of steel or other suitable material is used as a cathode. The anode and cathode are immersed in the electrolyte solution, and a direct or alternating current is passed through the electrolyte.

Although anodizing, itself, imparts satisfactory corrosion resistance to aluminum components, anodizing also suffers from several disadvantages. One disadvantage is the porosity of the oxide formed at the surface of the aluminum component. A typical anodizing treatment results in a porous polygonal cellular microstructure superimposed on a thin (less than 100 nm) "barrier" layer. The diameter of the pores in the microstructure can be as small as 10 nm. The cell dimension can be as small as about 30 nm.

The pores formed at the surface of anodized aluminum are undesirable because they tend to serve as corrosion sites, which give rise to deep pits. Deep pits in the anodized surface often result in "blooms" or white spots on the surface of the aluminum. In order to protect anodized aluminum from corrosion, especially in halide or salt-containing environments, the pores of the aluminum oxide customarily are sealed by immersion in a hot solution containing hexavalent chromium. A complex chemical reaction occurs, forming a solid compound of chromium, aluminum, oxygen, and some hydrogen within the pores of the anodized surface. This solid compound seals the pores against penetration by corrosive agents.

Unfortunately, hexavalent chromium solutions are toxic. The use and disposal of hexavalent chromium solutions therefore creates environmental concerns. These concerns, and their associated costs, have created an urgent need for an alternative sealing process that is free from such hazards.

Some have attempted to develop alternative sealing processes using other chemical solutions. To date, these alternative chemical solutions have not been entirely successful. A non-toxic, effective method for sealing anodized aluminum surfaces is urgently needed.

Most anodizing treatments require that the aluminum component be immersed in an aqueous solution. Even after drying, a film of water molecules (about two monolayers thick) tends to remain strongly adsorbed to the anodized surface. Where the anodized surface will be treated with a relatively hydrophilic sealant, the presence of such adsorbed water molecules should not interfere with the sealing process. However, if the anodized surface will be treated with a hydrophobic sealant, the adsorbed water molecules could interfere with the sealing process, and should be removed from the surface before the sealant is applied.

The removal of water molecules from an anodized surface is not a simple matter. Water molecules are polar, and thus have a charge distribution within the molecules, themselves. The attraction between the anodized surface and the polarized water molecules creates a weak bond which holds the water molecules to the anodized surface. In order to break this weak bond, the water molecules must be provided with enough energy to break free from the anodized surface.

A number of methods exist for freeing adsorbed water molecules from various surfaces. These methods include exposing the anodized surface to: sonar energy; heat; a flow of inert gas; a beam of de-focused electrons; and, UV light.

The use of sonar energy to free adsorbed water molecules has proven to be time consuming and not entirely successful. Heating of the surface is more successful in actually desorbing the water molecules from the surface; however, not all of the adsorbed water molecules are removed by heat, and the application of heat can be cumbersome and time consuming. A flow of inert gas, such as nitrogen, removes some adsorbed water molecules; however, the movement of the gas molecules is random, and it is likely that not all of the adsorbed water molecules will be removed by the gas. Whether de-focused electrons can successfully remove adsorbed water molecules from an anodized surface is not known; however, the technique has not been used commercially.

Water molecules absorb certain wavelengths of UV light. The absorbed energy should excite the water molecules into a vibrational mode, freeing the water molecules from the surface to which they are adsorbed. However, the UV light that has been used in the past to desorb water molecules from various surfaces has been relatively high intensity, or short wavelength UV light. The conventional source of UV light is a mercury vapor lamp. In most mercury vapor lamps, essentially all radiation having a wavelength shorter than 200 nm is shut off by a silica envelope. Water has a low coefficient of absorption in the relatively short wavelength ranges produced by mercury vapor UV lamps. As a result, a relatively long period of time has been required to desorb water molecules from a surface using short wavelength UV light.

A more effective and economic method is needed for removing adsorbed water molecules from anodized surfaces. Also needed is a method for sealing an anodized aluminum surface with a medium that is chemically inert and impermeable, using a process that results in byproducts that are less hazardous to the environment than hexavalent chromium.

SUMMARY OF THE INVENTION

The present invention provides a method for easily and effectively removing adsorbed water molecules from an anodized aluminum surface using low intensity ultraviolet (UV) radiation. The present invention also provides a method for sealing an anodized aluminum surface without producing hazardous byproducts. The method involves, in vacuum: (1) vaporizing a selected diamond-like or amorphous carbon precursor fluid; (2) condensing a flux of the diamond-like or amorphous carbon precursor vapor onto the anodized aluminum surface; (3) and, bombarding the condensed precursor vapor with an energetic beam of ions to convert the porous anodized surface into an inert, solid, impermeable, and mechanically strong amorphous or diamond like carbon coating.

DETAILED DESCRIPTION OF THE INVENTION

As used herein, "aluminum" shall mean aluminum and alloys thereof that are amenable to anodization. The sealing process of the present invention involves the application of a nonaqueous, relatively hydrophobic precursor fluid to an anodized aluminum surface. The presence of water molecules adsorbed to the anodized surface most likely would interfere with the application of the hydrophobic precursor fluid. Therefore, a method is provided for effectively removing adsorbed water molecules from the anodized surface before depositing the precursor fluid.

Water molecules have a much higher coefficient of absorption for UV light with a longer wavelength, in the region of 120–150 nm, than for the short wavelength UV light produced by conventional UV lamps. Exposure of adsorbed water molecules to low intensity UV light should result in more rapid, and more effective desorption of the water molecules from the anodized surface.

Longer wavelength UV radiation can be obtained using unconventional UV lamps, such as deuterium discharge lamps. Deuterium discharge lamps generate UV radiation having wavelengths down to 120 nm. These lower wavelength UV lamps can be modified, using special windows formed of substances such as magnesium fluoride, to transmit radiation down to wavelengths of about 110 nm.

To treat an anodized aluminum component, the component should placed in a vacuum chamber provided with: (a) a source of low intensity UV radiation; (b) a reservoir for vaporizing the precursor sealant fluid and directing the vapor onto the component; and (c) an ion gun or other suitable apparatus for accelerating ions and bombarding the component with an energetic beam of ions.

The pressure in the vacuum chamber should be pumped down to at least about $10^{-6}$ torr. In a preferred embodiment, a 150 watt UV lamp is used to produce UV radiation in the range of about 110–180 nm, preferably between about 120–150 nm. The surface of the anodized aluminum should be exposed to a flux of this low intensity UV radiation for a time sufficient to remove adsorbed water molecules from the anodized surface. Using a 150 watt lamp and 120–150 nm UV light, this should take about 20 minutes.

In a preferred embodiment, the reservoir is supplied with electrical resistance heating. The reservoir should contain a selected amorphous or diamond like carbon precursor fluid in an amount sufficient to volatilize and coat the component. A number of precursor materials for amorphous or diamond-like carbon coatings are known in the art, and any of the known precursor materials would be suitable for use in the present invention. Suitable precursor materials include diffusion pump materials which have a low vapor pressure and can be vaporized stably at room temperature. Preferable diffusion pump fluids include polyphenyl ether, polydimethyl siloxane, pentaphenyltrimethyl siloxane, and elcosyl napthalene. Persons of ordinary skill in the art will recognize that "diffusion pump fluids" are a discrete group of vacuum distilled, carbon-containing mineral oils, such as the Apiezon group, or synthetic oils, particularly the higher-order esters such as the phthalates and sebacates, or silicones and chlorinated hydrocarbon oils. Diffusion pump fluids are used to create a vacuum in a vacuum chamber using a diffusion pump. Diffusion pump fluids have the following common features: (a) they contain carbon; (b) they must not have substantial vapor pressure, which could increase the pressure in the vacuum chamber; and, (c) they must be able to vaporize thermally and condense onto a cooled surface without decomposing in the process.

Other carbon-containing materials besides diffusion pump fluids that are suitable for use as precursor materials include fullerenes (described in U.S. Pat. No. 5,393,572, incorporated herein by reference) and parylenes (described in U.S. Pat. No. 5,512,330, incorporated herein by reference). Preferably, the reservoir should be heated to an appropriate temperature to vaporize the selected precursor, and the resulting vapor flux should be directed through an aperture or nozzle to direct the flux toward the surface to be sealed until a preferred coating thickness of between about 1–5$\mu$ is achieved. The thickness of the coating may be monitored by standard methods, e.g., using the frequency charge of a quartz crystal oscillator.

At the same time, the component should be bombarded, either in a continuous or interrupted fashion, with an energetic beam of ions. A beam of substantially any energetic ions should function in the present invention. Preferable ions are preferably ionized gaseous species such as hydrogen, helium, neon, nitrogen, argon, methane, carbon monoxide, or other relatively low mass gaseous elements or compounds. The energy of bombardment must be sufficient to ionize the constituent molecules in the precursor film, and to rupture the bonds between hydrogen and other atoms, such as carbon and silicon, thereby releasing the hydrogen into the surrounding vacuum to be pumped away, leaving an amorphous or diamond-like carbon coating. The energy of bombardment can range from between about 1 keV to about 1 MeV, but preferably should be between about 20 keV to about 100 keV.

The rate of arrival of the ions should be controlled in relation to the rate of arrival of the precursor molecules. This process should require about one ion for every 100 atoms in the final product coating; however, the ion-to-atom ratio will vary according to the mass and energy of the ion species. Persons skilled in the art will recognize how to achieve the correct linear energy transfer in the ionizing process.

The ion bombardment should be continued until the precursor molecules are ionized and converted into an inert, solid, impermeable, and mechanically strong amorphous or diamond-like carbon coating. The amount of time required to achieve this conversion will vary with the intensity of the ion beam. At an ion-to-atom ratio of 1 to 100 and an energy of about 20 keV to about 100 keV, about 30 minutes of ion bombardment should be sufficient. Depending upon the chemical nature of the precursor, the resulting surface should be carbonaceous, silicaceous, or a blend of carbon and silicon product, with some residual hydrogen and—if oxygen was present in the precursor—residual oxygen.

Persons of skill in the art will appreciate that many modifications may be made to the embodiments described herein without departing from the spirit of the present invention. Accordingly, the embodiments described herein are illustrative only and are not intended to limit the scope of the present invention.

We claim:

1. A method for sealing a porous anodized aluminum surface comprising:

placing a component having an anodized aluminum surface in a vacuum chamber evacuated to a pressure of about $10^{-6}$ torr;

condensing onto said surface a precursor material in an amount sufficient, upon ion bombardment, to form an inert, substantially impermeable amorphous carbonaceous seal;

substantially simultaneously bombarding said anodized surface with an energetic beam of ions at an energy between about 1 keV to about 1 Mev for a time and at a linear energy of transfer sufficient to convert said precursor material into said inert, substantially impermeable amorphous carbonaceous seal.

2. The method of claim 1 wherein said energy of ion bombardment is between about 20–100 keV.

3. The method of claim 2 wherein, before condensing said precursor material onto said surface, said surface is exposed to a flux of UV radiation having a wavelength between about 110–180 nm and a power of about 150 watts for a time sufficient to remove adsorbed water molecules from said surface.

4. The method of claim 3 wherein said UV radiation has a wavelength between about 160–170 nm.

5. The method of claim 2 wherein said precursor material is deposited onto said surface to a thickness of between about 1–5$\mu$.

6. The method of claim 1 wherein said ions are selected from the group consisting of hydrogen, helium, neon, nitrogen, argon, methane, and carbon monoxide.

7. The method of claim 6 wherein said precursor material is deposited onto said surface to a thickness of between about 1–5$\mu$.

8. The method of claim 1 wherein, before condensing said precursor material onto said surface, said surface is exposed to a flux of UV radiation having a wavelength between about 110–180 nm and a power of about 150 watts for a time sufficient to remove adsorbed water molecules from said surface.

9. The method of claim 8 wherein, before condensing said precursor material onto said surface, said surface is exposed to a flux of UV radiation having a wavelength between about 110–180 nm and a power of about 150 watts for a time sufficient to remove adsorbed water molecules from said surface.

10. The method of claim 9 wherein said UV radiation has a wavelength between about 160–170 nm.

11. The method of claim 8 wherein said precursor material is deposited onto said surface to a thickness of between about 1–5$\mu$.

12. The method of claim 1 wherein said precursor material is deposited onto said surface to a thickness of between about 1–5$\mu$.

13. The method of claim 12 wherein said precursor material is deposited onto said surface to a thickness of between about 1–5$\mu$.

14. A method for sealing a porous anodized aluminum surface comprising:

placing a component having an anodized aluminum surface in a vacuum chamber evacuated to a pressure of about $10^{-6}$ torr;

condensing onto said surface a precursor material in an amount sufficient, upon ion bombardment, to form an inert, substantially impermeable amorphous carbonaceous seal, wherein said precursor material is selected from the group consisting of polyphenyl ether, polydimethyl siloxane, pentaphenyltrimethyl siloxane, and elcosyl napthalene;

substantially simultaneously bombarding said anodized surface with an energetic beam of ions at an energy between about 1 keV to about 1 Mev for a time and at a linear energy of transfer sufficient to convert said precursor material into said inert, substantially impermeable amorphous carbonaceous seal.

15. The method of claim 14 wherein said ions are selected from the group consisting of relatively low mass gaseous elements and compounds.

16. The method of claim 15 wherein said energy of ion bombardment is between about 20–100 keV.

17. The method of claim 16 wherein said ions are selected from the group consisting of hydrogen, helium, neon, nitrogen, argon, methane, and carbon monoxide.

18. The method of claim 16 wherein, before condensing said precursor material onto said surface, said surface is exposed to a flux of UV radiation having a wavelength between about 110–180 nm and a power of about 150 watts for a time sufficient to remove adsorbed water molecules from said surface.

19. The method of claim 18 wherein said UV radiation has a wavelength between about 160–170 nm.

20. The method of claim 15 wherein said ions are selected from the group consisting of hydrogen, helium, neon, nitrogen, argon, methane, and carbon monoxide.

21. The method of claim 15 wherein, before condensing said precursor material onto said surface, said surface is exposed to a flux of UV radiation having a wavelength between about 110–180 nm and a power of about 150 watts for a time sufficient to remove adsorbed water molecules from said surface.

22. The method of claim 21 wherein said UV radiation has a wavelength between about 160–170 nm.

23. The method of claim 22 wherein said UV radiation has a wavelength between about 160–170 nm.

24. The method of claim 22 wherein said precursor material is deposited onto said surface to a thickness of between about 1–5$\mu$.

25. The method of claim 15 wherein said precursor material is deposited onto said surface to a thickness of between about 1–5$\mu$.

26. The method of claim 14 wherein said energy of ion bombardment is between about 20–100 keV.

27. A method for sealing a porous anodized aluminum surface comprising:

placing a component having an anodized aluminum surface in a vacuum chamber evacuated to a pressure of about $10^{-6}$ torr;

condensing onto said surface a precursor material in an amount sufficient, upon ion bombardment, to form an inert, substantially impermeable amorphous carbonaceous seal, wherein said precursor material is selected from the group consisting of polyphenyl ether, polydimethyl siloxane, pentaphenyltrimethyl siloxane, and elcosyl napthalene;

substantially simultaneously bombarding said anodized surface with an energetic beam of ions at an energy between about 1 keV to about 1 Mev for a time and at a linear energy of transfer sufficient to convert said precursor material into said inert, substantially impermeable amorphous carbonaceous seal, wherein said ions are selected from the group consisting of hydrogen, helium, neon, nitrogen, argon, methane, and carbon monoxide.

* * * * *